United States Patent [19]

Mizumura et al.

[11] Patent Number: 4,626,809

[45] Date of Patent: Dec. 2, 1986

[54] BANDPASS FILTER WITH DIELECTRIC RESONATORS

[75] Inventors: Motoo Mizumura; Hisasuke Sei, both of Tokyo, Japan

[73] Assignee: NEC Corporation, Tokyo, Japan

[21] Appl. No.: 778,104

[22] Filed: Sep. 20, 1985

[30] Foreign Application Priority Data

Sep. 27, 1984 [JP] Japan ..... 59-202337

[51] Int. Cl.[4] ..... H01P 1/20; H01P 1/219; H01P 7/10

[52] U.S. Cl. ..... 333/202; 333/209; 333/210; 333/235

[58] Field of Search ..... 333/24 R, 21 R, 27, 333/202-212, 219, 222, 231, 232, 235, 246, 248; 334/41-45

[56] References Cited

U.S. PATENT DOCUMENTS 4,037,182 7/1977 Burnett et al. ..... 333/209 X 4,142,164 2/1979 Nishikawa et al. ..... 333/202 X

FOREIGN PATENT DOCUMENTS 0207701 12/1983 Japan ..... 333/208

*Primary Examiner*—Marvin L. Nussbaum

*Attorney, Agent, or Firm*—Sughrue, Mion, Zinn, Macpeak & Seas

[57] ABSTRACT

A bandpass filter in which a plurality of dielectric resonators are arranged in an array is disclosed. Two metallic posts each having a length which is substantially equal to a quarter of the wavelength of the fundamental frequency (center frequency of the bandpass filter) are arranged one between the dielectric resonator located at one end of the array and an input connector and the other between the dielectric resonator located at the other end of the array and an output connector. This suppresses propagation of spurious modes, particularly propagation at a twice higher frequency than the fundamental frequency.

6 Claims, 10 Drawing Figures

BANDPASS FILTER WITH DIELECTRIC RESONATORS

BACKGROUND OF THE INVENTION

The present invention relates to an improvement in a bandpass filter using dielectric resonators which shows a desirable propagation characteristic.

A prior art dielectric resonators bandpass filter (DR-BPF) comprises a plurality of dielectric resonators arranged in an array within a metal housing, metal screws associated in one-to-one correspondence with the dielectric resonators to adjust their resonant frequencies, and an input and an output connectors mounted on the housing. Two probes extend into the housing one from the input connector and the other from the output connector such that the connectors respectively are electromagnetically coupled with those dielectric resonators which are located at both ends of the array.

Basically, the role which a bandpass filter is to fulfill is transmitting signals which lie in a desired frequency band while intercepting all the frequencies outside the desired band. However, the prior art DF-FPF involves propagation of some needless or spurious modes one of which is the higher-order mode resonance of the dielectric resonators. Another spurious mode is the resonance of the metal housing or, more precisely, resonance due to interaction of the metal housing and the dielectric resonators which are installed in the housing. Stated another way, while an input signal is transmitted through the DR-BPF to be outputted therefrom, the spurious higher order mode of each dielectric resonator and the spurious mode due to resonance of the housing are propagated together with a desired dominant mode. In this manner, since the prior art DR-BPF is not furnished with a function of implementing a frequency characteristic which suppresses propagation of spurious modes, all the spurious modes are allowed to propagate through the DR-BPF. Propagation of those spurious modes is problematic in realtion to a DR-BPF which is applied to a communications system and others which are in practical use.

SUMMARY OF THE INVENTION

It is an object of the present invention to provide an improved DR-BPF which eliminates propagation of spurious modes by suppressing propagation at a frequency twice the center frequency, which is determined by the dominant mode of dielectric resonators.

It is another object of the present invention to provide a generally improved DR-BPF.

A bandpass filter of the present invention comprises a metallic housing, a plurality of dielectric resonators arranged in an array in the housing, a signal input connector and a signal output connector each being mounted in the housing, and an elongate metallic input post and an elongate metallic output post each being disposed in the housing to be connected to the housing at one end and open at the other end and respectively being connected to the signal input and signal output connectors. Each of the signal input and signal output posts has a length which is substantially equal to a quarter of a wavelength of a center frequency of the bandpass filter.

In accordance with the present invention, a bandpass filter in which a plurality of dielectric resonators are arranged in an array has two metallic posts each having a length which is substantially equal to a quarter of the wavelength of the fundamental frequency (center frequency of the bandpass filter). These metallic posts are arranged one between the dielectric resonator located at one end of the array and an input connector and the other between the dielectric resonator located at the other end of the array and an output connector. This suppresses propagation of spurious modes, particularly propagation at a twice higher frequency than the fundamental frequency.

The above and other objects, features and advantages of the present invention will become more apparent from the following detailed description taken with the accompanying drawings.

DESCRIPTION OF THE PREFERRED EMBODIMENTS

While the DR-BPF of the present invention is susceptible of numerous physical embodiments, depending upon the environment and requirements of use, substantial numbers of the herein shown and described embodiments have been made, tested and used, and all have performed in an eminently satisfactory manner.

Figure 1A:
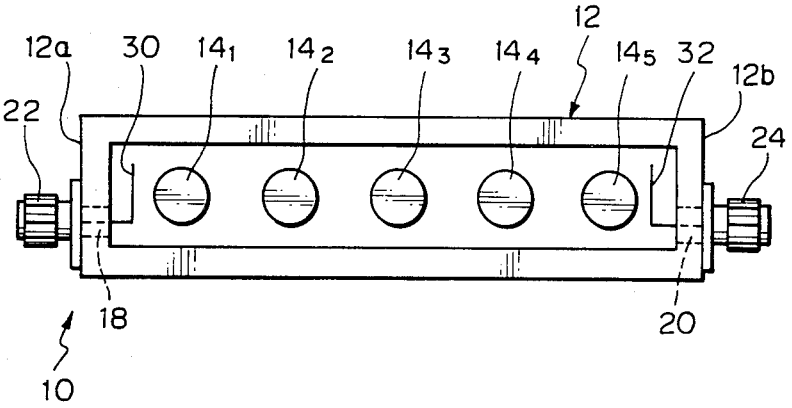
Fig. 1A PRIOR ART
FIG. 1A is a top plan view of a prior art DR-BPF a metal cover of which is omitted for clarity.
Figure 1B:
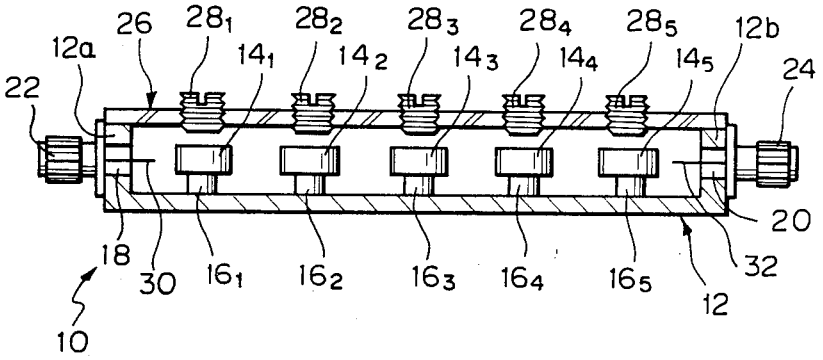
Fig. 1B PRIOR ART
FIG. 1B is a sectional side elevation of the DR-BPF of FIG. 1.
Figure 2:
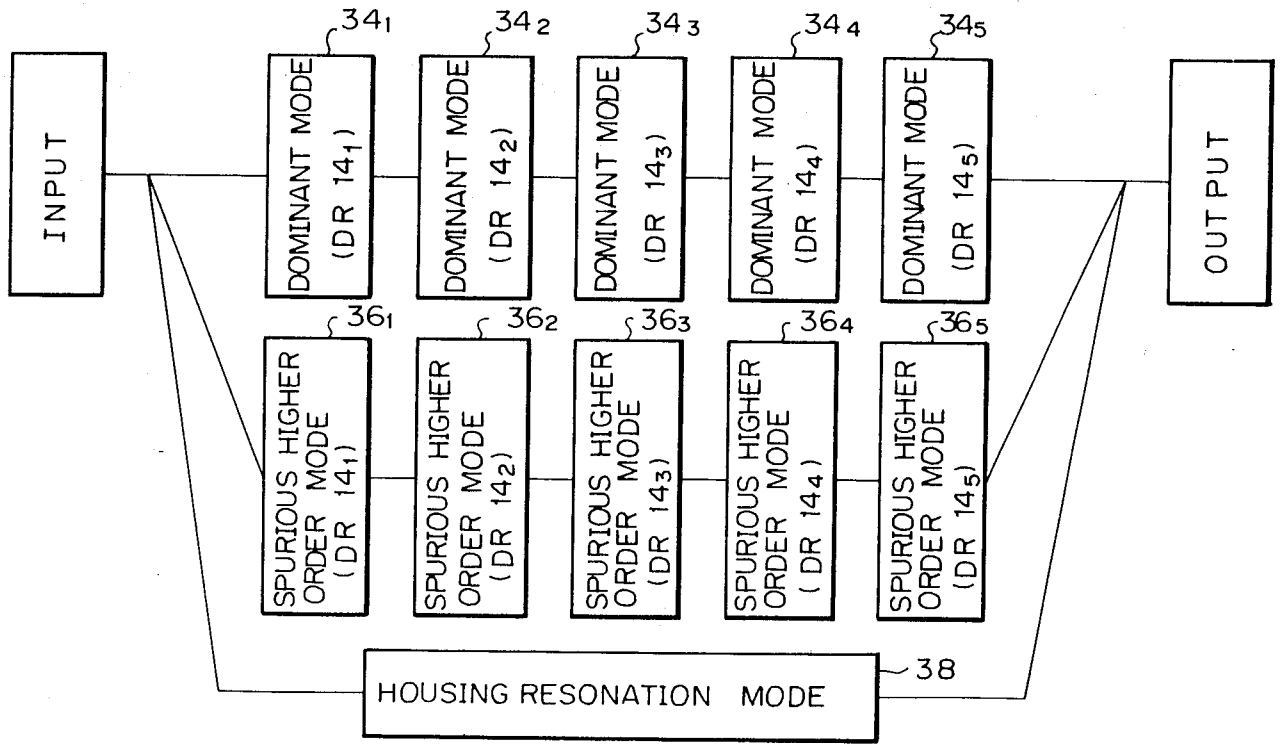
FIG. 2 is a view schematizing propagation of dominant and spurious modes which occur in the DR-BPF of FIGS. 1A and 1B.
Figure 3:
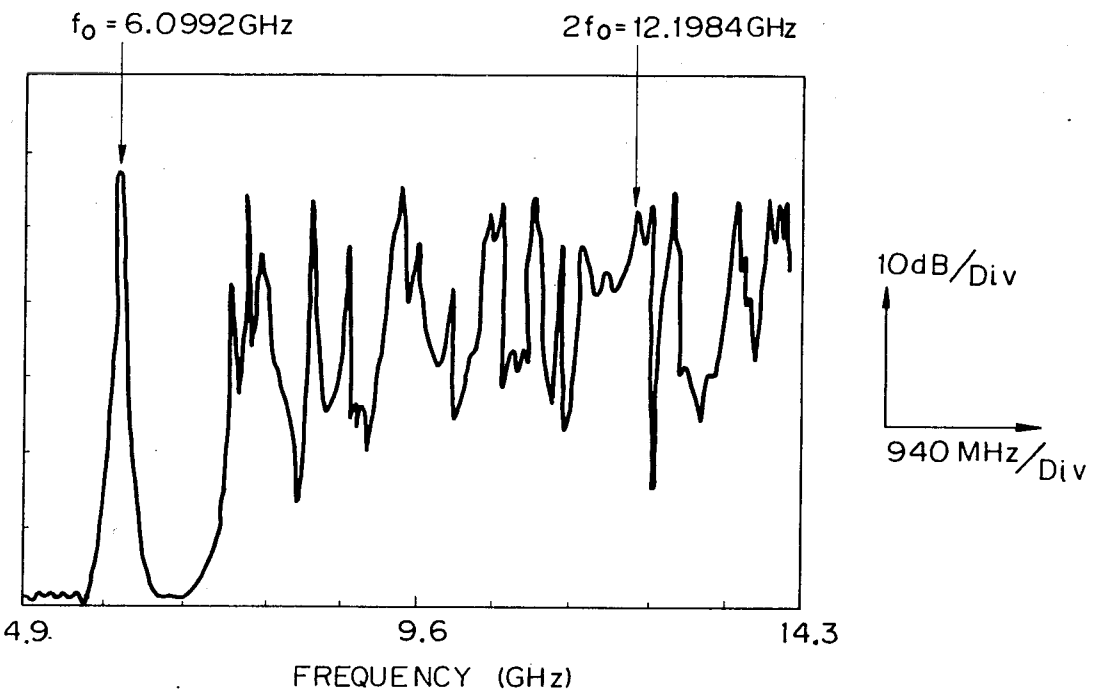
Fig. 3 PRIOR ART
FIG. 3 is a plot showing a frequency characteristic of the DR-BPF of FIGS. 1A and 1B.

To better understand the present invention, a brief reference will be made to a prior art DR-BPF, shown in FIGS. 1A, 1B, 2 and 3. As shown in FIGS. 1A and 1B, the prior art DR-BPF, generally 10, includes a metal housing 12 having an elongate rectangular parallelepipedic configuration. A plurality of (five in the illustrative construction) dielectric resonators $\mathbf{14_1}$–$\mathbf{14_5}$ are arranged in an array within the housing 12 and rigidly mounted, respectively, on support members $\mathbf{16_1}$–$\mathbf{16_5}$. The housing 12 is provided with perforations 18 and 20 through its longitudinally opposite end walls **12*a* and 12*b*, respectively. A signal input connector 22 is fit in the perforation 18 and a signal output connector 24 in the perforation 20. A metal cover 26 closes the open top of the housing 12. Metal screws $\mathbf{28_1}$–$\mathbf{28_5}$ are rotatably mounted in the cover 26 to face the dielectric resonators $\mathbf{14_1}$–$\mathbf{14_5}$, respectively. The screws $\mathbf{28_1}$–$\mathbf{28_5}$ are adapted to adjust the resonant frequencies of the resonators $\mathbf{14_1}$–$\mathbf{14_5}$ associated therewith. A probe 30** extends from the input connector 22 into the housing 12 to electromagnetically couple the connector 22 to the leftmost resonator $14_1$ in the array. Likewise, a probe 32 extends from the output connector 24 into the housing 12 so that the connector 24 may be electromagnetically coupled with the rightmost resonator $14_5$ in the array.

As previously discussed, the prior art DR-BPF shown and described propagate even undesired or spurious modes such as the higher order mode of each dielectric resonator $14_1$–$14_5$ and resonance mode of the housing 12. Propagation of such spurious or undesired modes is schematized in FIG. 2. As shown, while a signal coming through the input connector 22 is transmitted through the DR-BPF 10 and leaves it through the output connector 24, not only dominant modes $34_1$–$34_5$ of the resonators $14_1$–$14_5$ but also spurious higher order modes $36_1$–$36_5$ of the resonators $14_1$–$14_5$ and a resonance mode 38 of the housing 12 are propagated.

All the spurious modes are propagated because the prior art DR-BPF 10 lacks the function of implementing a frequency characteristic which suppresses propagation of spurious modes. A frequency characteristic of the prior art DR-BPF 10 which was actually measured with a center frequency $f_o$ of 6.0992 GHz is plotted in FIG. 3. As well known in the art, the center frequency $f_o$ has dependence on the dominant modes $34_1$–$34_5$ of the dielectric resonators $14_1$–$14_5$. It will be seen from the plot that spurious modes are propagated at higher frequencies. Especially, they are little attenuated during the propagation at a frequency which is twice the center frequency $f_o$, i.e. $2f_o = 12.2984$ GHz.

Figure 4A:
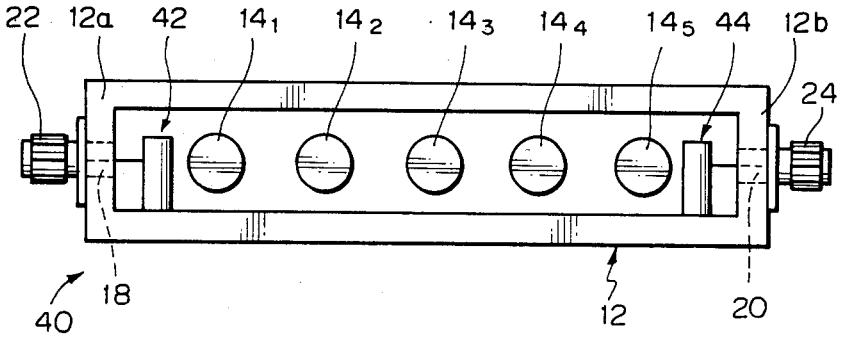
FIG. 4A is a top plan view of a DR-BPF embodying the present invention in which a metal cover is omitted for clarity.
Figure 4B:
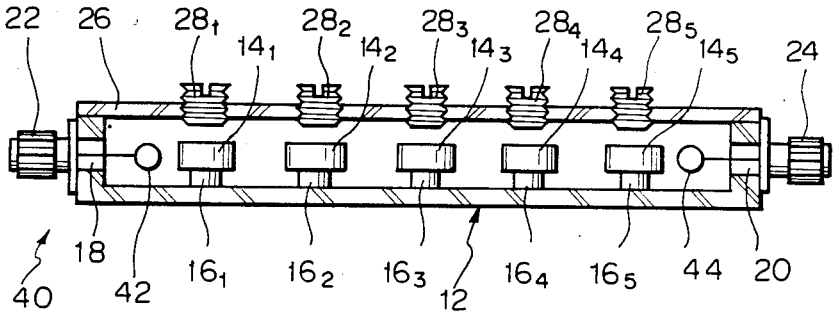
FIG. 4B is a sectional side elevation of the DR-BPF of FIG. 4A.

Referring to FIGS. 4A and 4B, an improved DR-BPF embodying the present invention is shown and generally designated by the reference numeral 40. In FIGS. 4A and 4B, the same or similar structural elements as those shown in FIGS. 1A and 1B are designated by like reference numerals. In this particular embodiment, the probes 30 and 32 of the prior art DR-BPF 10 are replaced by metallic posts 42 and 44 which respectively are connected to an input connector 22 and an output connector 24. Each of the posts 42 and 44 is connected to a housing 12 at one end and open at the other end. The posts 42 and 44 are each provided with a length l which is substantially equal to a quarter of the wavelength of the fundamental frequency $f_o$ of the DR-BPF 40. Specifically, the post 42 or 44 is provided at each side of the DR-BPF 40. The electrical length of the post 42 or 44 is designed equal to one-quarter of the wavelength at the midband frequency of the DR-BPF 40. The bottom end of each post 42 or 44 is shortcircuited, while the top end is open-circuited. Each end resonator is electromagnetically coupled to its adjacent post 42 or 44 at the center frequency of the DR-BPF 40. As a result, a dominant frequency band microwave signal can propagate. The electrical length of each post 42 or 44 becomes equal to one-half wavelength for the component at twice the center frequency. Consequently, both ends of each post 42 or 44 are almost short-circuited and, hence, twice the center frequency component almost fails to be propagated. This, is equivalent to saying that the second harmonic attenuation characteristics of the DR-BPF of the present invention are greatly improved.

It will be noted that the cross-section of the posts 42 and 44 may either be circular or polygonal.

Figure 5:
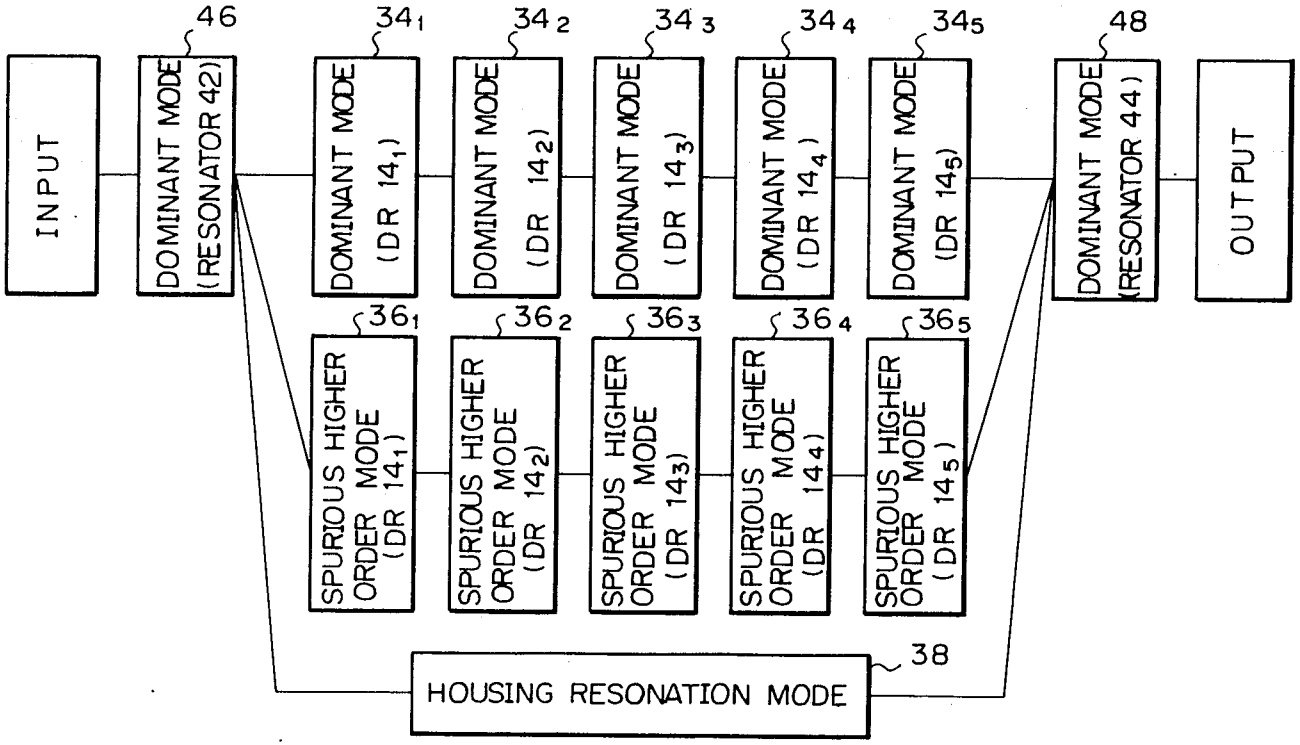
FIG. 5 is a schematic view which models mode propagation which is particular to the DR-BPF of FIGS. 4A and 4B.
Figure 6:
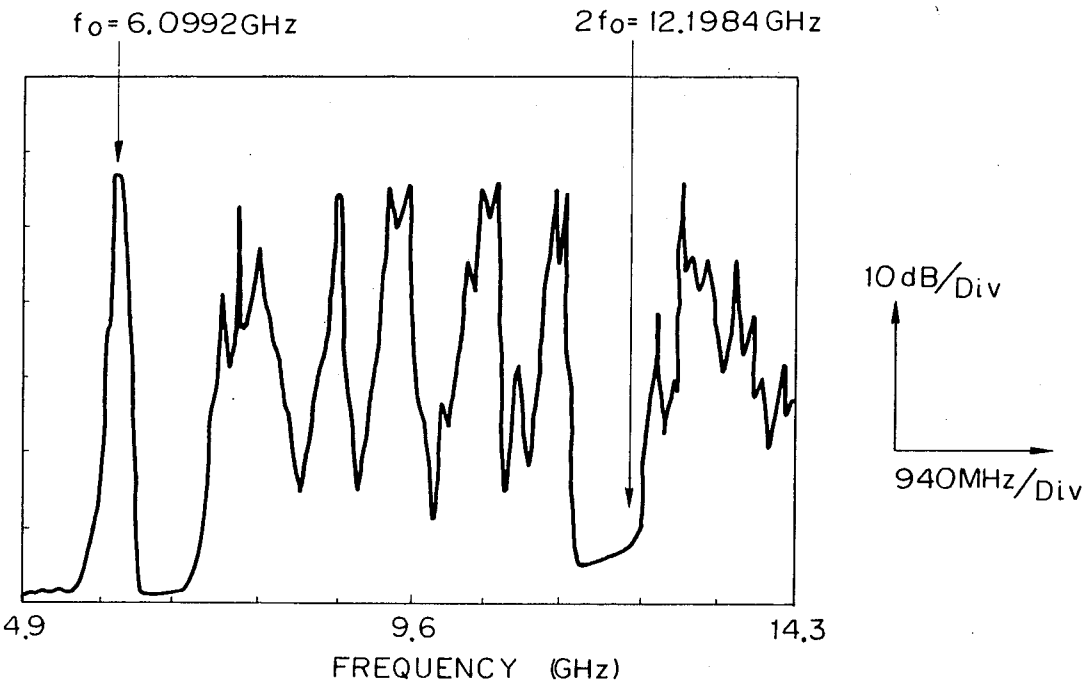
FIG. 6 is a plot showing a frequency characteristic attainable with the embodiment of the present invention.

The mode propagation which occurs in the DR-BPF 40 of the present invention may be schematized as shown in FIG. 5. The frequency characteristic of the DR-BPF 40 which was actually measured with a fundamental frequency $f_o$ of 6.0992 GHz is shown in FIG. 6. As shown, spurious modes are attenuated by about 45 dB at the frequency of 12.1984 GHz which is double the fundamental frequency $f_o$. This proves that only the spurious response of the $2f_o$ component has been remarkably improved.

Figure 7:
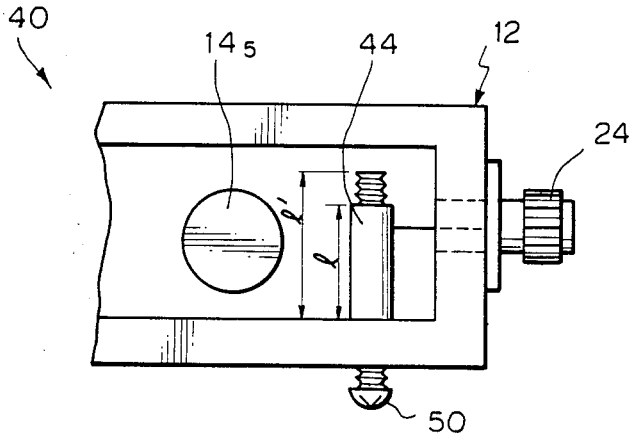
FIG. 7 is a fragmentary plan view of another embodiment of the present invention.
Figure 8:
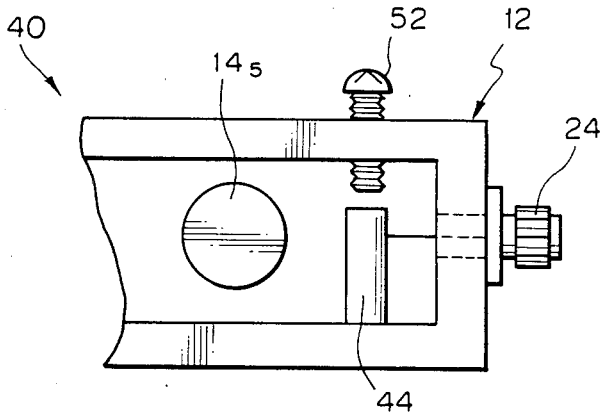
FIG. 8 is a view similar to FIG. 7 but showing still another embodiment of the present invention.

The metallic posts 42 and 44 have been shown and described as having a fixed length which is substantially a quarter of the wavelength of the DR-BPF fundamental frequency $f_o$. Alternatively, as shown in FIG. 7, the post 44 may be designed to have a variable length l by means of a screw structure 50 for the purpose of coping with changes in the center frequency (fundamental frequency) of the DR-BPF 40. Furthermore, as shown in FIG. 8, a metal screw 52 may be employed to provide a projection which opposes the open end of the post 44 to load capacitance and, thereby, render the length of the post 44 equivalently variable.

As described hereinabove, the posts 42 and 44 of the DR-BPF 40 in accordance with the present invention are each dimensioned to have a length equal to about a quarter of the wavelength of the DR-BPF fundamental frequency $f_o$. Therefore, they propagate a dominant mode due to the length which is a quarter of the wavelength of the fundamental frequency $f_o$. However, the open end of each of the posts electromagnetically serves as a short-circuited plane for the frequency of $2f_o$, thereby intercepting a signal whose frequency is $2f_o$. Hence, considering the frequency response from the input end to the output end, a signal with the frequency of $2f_o$ can be attenuated.

Various modifications will become possible for those skilled in the art after receiving the teachings of the present disclosure without departing from the scope thereof.

What is claimed is:

1. A bandpass filter comprising:
a metal housing;
a plurality of dielectric resonators arranged in an array in said housing;
a signal input connector and a signal output connector each being mounted in the housing; and
an elongate metallic input post and an elongate metallic output post each being disposed in the housing to be connected to the housing at one end and open at the other end and respectively being connected to the signal input and signal output connectors,
wherein each of the signal input and signal output posts having a length which is substantially equal to a quarter of a wavelength of a center frequency of the bandpass filter is adapted for removing a spurious mode having a frequency that is twice said center frequency.

2. A bandpass filter as claimed in claim 1, wherein each of the signal input and signal output posts comprises adjuster means for adjusting the length of the posts.

3. A bandpass filter as claimed in claim 2, wherein said adjuster means comprises a metallic screw which is passed through the post to be extendible in a lengthwise direction of the post.

4. A bandpass filter as claimed in claim 2, wherein the adjuster means comprises a metallic screw which is provided with a projection which faces the open end of the post and movable toward and away from the post.

5. A bandpass filter as claimed in claim 1, further comprising a metallic cover for closing an open top of the housing, and metallic screws which face the dielectric resonators in one-to-one correspondence and are individually movable toward and away from the dielectric resonators associated therewith to adjust resonant frequencies of the associated dielectric resonators.

6. A bandpass filter comprising:

a metal housing;

a plurality of dielectric resonators arranged in an array in said housing;

a signal input connector and a signal output connector each being mounted in the housing; and an elongate metallic input post and an elongate metallic output post each being disposed in the housing to be connected to the housing at one end and open at the other end and respectively being connected to the signal input and signal output connectors, wherein each of the signal input and signal output posts having a length which is substantially equal to a quarter of a wavelength of a center frequency of the bandpass filter, and each of said signal input and signal output posts comprises an adjuster means for adjusting the length of said post, said adjuster means comprising a metallic screw which is passed through said post to be extendible in a lengthwise direction of said post.

* * * * *